United States Patent [19]

Thuries

[11] Patent Number: 4,553,004

[45] Date of Patent: Nov. 12, 1985

[54] PUFFER-TYPE GAS-BLAST CIRCUIT-BREAKER

[75] Inventor: Edmond Thuries, Meyzieu, France

[73] Assignee: Alsthom-Atlantique, Paris, France

[21] Appl. No.: 588,174

[22] Filed: Mar. 12, 1984

[30] Foreign Application Priority Data

Mar. 11, 1983 [FR] France ..... 83 04040

[51] Int. Cl.[4] ..... H01H 33/88

[52] U.S. Cl. ..... 200/148 A

[58] Field of Search ..... 200/148 A, 152 G, 148 R

[56] References Cited

U.S. PATENT DOCUMENTS

| | | | |
|---|---|---|---|
| 3,331,935 | 7/1967 | Milianowicz | 200/148 A |
| 3,551,623 | 12/1970 | Colclaser, Jr. et al. | 200/148 A |
| 4,041,263 | 8/1977 | Noeske | 200/148 A |
| 4,438,308 | 3/1984 | Korner et al. | 200/148 A |

FOREIGN PATENT DOCUMENTS

| | | | |
|---|---|---|---|
| 1179910 | 2/1970 | United Kingdom | 200/148 A |

*Primary Examiner*—Robert S. Macon

*Attorney, Agent, or Firm*—Sughrue, Mion, Zinn, Macpeak & Seas

[57] ABSTRACT

The circuit breaker has linear displacement moving contacts (3, 4) coupled to a fixed cylinder blast assembly (6) having two concentric pistons (7, 8). The first piston (7) is fixed to the moving contact equipment and is actuated by the circuit breaker control mechanism. The second piston (8) is free and is driven by electrodynamic energy from the current being interrupted. A spring (23) urges the second piston (8) towards the top (16) of the cylinder. Coupling means (30) which lock the second piston (8) when it reaches the top of the cylinder are released by the first piston (7) when it leaves the vicinity of the top (16) of the cylinder. It only requires small operating energy while enabling small intensity and large intensity currents to be interrupted by matching itself thereto.

10 Claims, 14 Drawing Figures

PUFFER-TYPE GAS-BLAST CIRCUIT-BREAKER

The invention relates to a puffer-type gas-blast circuit-breaker using the electrodynamic energy created by the current to reduce the operating force that needs to be supplied.

Puffer-type, gas-blast circuit-breakers comprise, in known manner, an interrupter constituted by fixed main contact fingers and arcing contact fingers co-operating with main contact fingers and arcing contact fingers which are placed on moving equipment which also includes a blast nozzle and a piston and cylinder blast assembly supplying compressed gas to the blast nozzle. When the interrupter is opened, the moving equipment moves away from the fixed contacts while compressing the gas contained in the cylinder towards to the blast nozzle for extinguishing the arc which is drawn between the arcing contacts.

The energy available for operating the moving equipment and the size of the blast assembly are determined for interrupting a maximum intensity current, and are thus ill suited for interrupting a small amplitude current. Too much energy is then available for operating the moving equipment and the blast, and the arc is extinguished at a moment other than the current's natural passage through zero, thereby causing voltage spikes on opening. Further, when small currents of capacitive origin are interrupted, where the interruption may be followed by a large voltage step, it is advisable, unlike interrupting maximum amplitude currents, to give precedence to opening speed over arc extinction.

The object of the present invention is a circuit breaker which requires only small operating energy, while adapting itself to interrupting both low and high intensity currents.

The present invention provides a circuit breaker having a gas-blast assembly with a fixed cylinder and two concentric pistons which sweep the internal volume of the cylinder: a first piston which is driven by the circuit breaker actuator mechanism and which serves as the moving equipment for the moving contacts; and a second piston which is free and which is placed together with the bottom of the cylinder that delimits the blast volume in a current loop used by the opening current which passes via the arcing contacts, said opening current passing therethrough in the same radial direction as it passes through the bottom of the cylinder; resilient return means placed inside the cylinder urging the second piston against the top of the cylinder in such a manner as to maximize the blast volume; and coupling means which lock the second piston when it reaches the top of the cylinder under the action of the resilient return means and which are released by the first piston when it leaves the vicinity of the top of the cylinder because of an instruction to open the circuit breaker.

Preferably, the stroke of the second piston towards the bottom of the cylinder is limited by abutting against the back of the first piston.

In a particular embodiment, the coupling means comprise a system of hooks placed on the back of the second piston which hook under the action of springs onto an edge in the wall of the top of the cylinder and which are drawn by the first piston when it leaves the vicinity of the top of the cylinder by means of ties actuated by pneumatic suction as the back of the first piston moves out from a chamber hollowed out in the second piston or by magnetic attraction.

In another embodiment, the coupling means comprise a captive ball locking system with a locking ring.

Other characteristics and advantages of the invention will appear from the accompanying claims and from the following description of several embodiments given by way of example. The description is made with reference to the accompanying drawings, in which:

Figure 1:
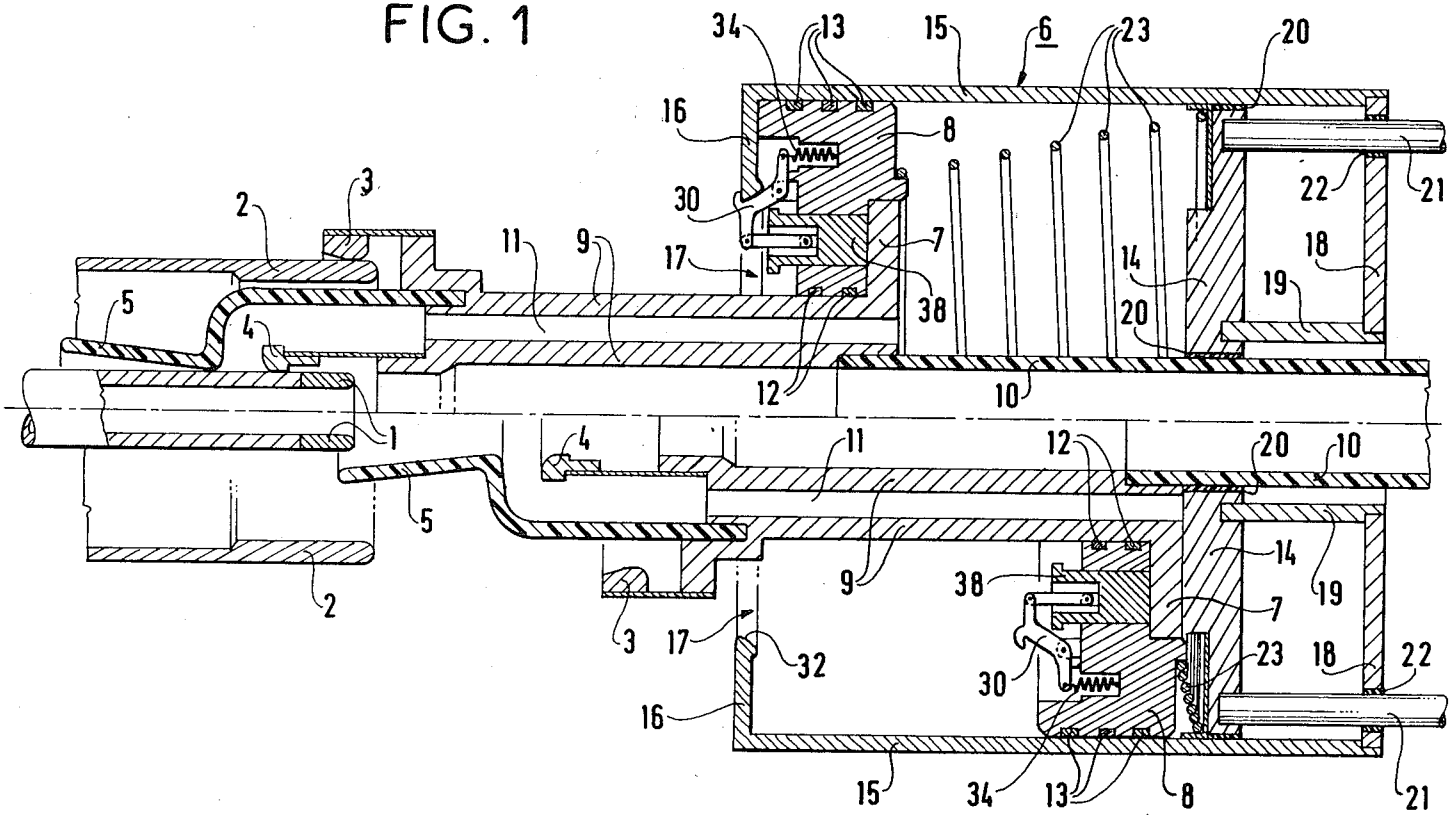
FIG. 1 is a longitudinal section through the interrupter of a circuit breaker in accordance with the invention with its various parts shown in the closed position and in the open position.

FIG. 1 shows the interrupter of a gas-blast circuit breaker for enclosing in a sealed housing filled with insulating gas of high interrupting power such as $SF_6$. The interrupter comprises, in conventional manner, a tubular fixed arcing contact 1 surrounded by a tubular fixed main contact 2 which co-operates with linearly displaceable moving contacts which are also tubular, namely a main contact 3 and an arcing contact 4. A blast nozzle 5 which receives gas from a fixed cylinder blast assembly 6 surrounds the moving arcing contact 4 inside the moving main contact 3 and engages the fixed arcing contact 1 inside the fixed main contact 2 to define a passage for compressed gas through the arcs which are drawn between the fixed and the moving arcing contacts 1 and 4.

The fixed cylinder 6 of the blast assembly is placed in the contact axis. It has two concentric pistons 7 and 8 moving therein. The first piston 7 (which is the inner piston) is fixed between two axial cylinders or tubes which pass through the blast cylinder 6; one of them 9 is made of metal and projects beyond the blast cylinder towards the fixed contacts 1 and 2 and serves as the means for moving the moving contacts 3 and 4 and the nozzle 5, while the other of them 10 is insulating, of smaller diameter, projects beyond the blast cylinder away from the fixed contacts, and is coupled to the mechanism for actuating the circuit breaker to cause the moving contacts 3 and 4 to move. The metal cylinder 9 has a longitudinal channel 11 putting the blast nozzle 5 in communication with the inside volume of the blast cylinder 6.

The first piston 7 is of smaller diameter than the inside diameter of the blast cylinder 6 and provides only a small blast effect due to its metal rod 9 entering into the volume of the blast cylinder, since the metal rod 9 takes up more volume than the insulating rod 10 which it replaces.

The second piston 8 is free. It slides between the metal cylinder 9 of the first piston 7 and the inner side wall of the blast cylinder 6, metal sealing rings 12 and 13 ensuring sealing and electrical contact between the various sliding parts. It is made of metal and is electrodynamically drawn towards the bottom 14 of the blast cylinder 6 by the passage of current through the interrupter. To do this, the piston is placed in a current loop constituted by: the metal side walls 15 of the blast cylinder 6 which it puts into electrical contact with the metal rod 9 on which the moving contacts are mounted (said contacts being insulated from the metal wall 16 at the top of the blast cylinder 6 by an annular slot 17); by a metal washer 18 which is parallel with the outside of the bottom 14 of the blast cylinder 6 and which is in electrical contact via its periphery with the metal side walls 15 of the blast cylinder; by a metal tube 19 through which the insulating rod 10 of the first piston 7 passes and which electrically interconnects the center of the metal washer 18 with the center of the bottom 14 of the blast cylinder 6; by the bottom 14 of the blast cylinder 6 which is made of metal and which is electrically insulated from the metal side walls 15 of the blast cylinder 6 by means of insulating packing 20; and by cross members 21 placed at the outside of the metal bottom 14 of the blast cylinder 6 at its periphery, passing through the parallel metal washer 18 while being electrically insulated therefrom by insulating packing 22, and serving to carry away the electrical current passing through the interrupter. By virtue of this arrangement, the second piston 8 and the bottom 14 of the blast cylinder have an electrical current passing through them radially and in the same direction thereby setting up attraction forces between these two parts by the electrodynamic effect.

A return spring 23 is placed inside the blast cylinder 6 between the bottom 14 and the second piston 8. It urges the second piston against the top 16 of the cylinder and opposes its being moved by the electrodynamic forces which are set up by small interruption currents. It is advantageously adjusted to develop a force which is a little higher than the force developed on the second piston 8 by a current of nominal intensity.

Coupling means which are described in greater detail with reference to the following figures lock the second piston 8 when it reaches the top 16 of the blast cylinder under the action of the return spring 23, thereby avoiding untimely movement of the second piston 8, in particular when closing the interrupter on a short circuit. The coupling means are freed by the first piston 7 when it leaves the vicinity of the top 16 of the blast cylinder in response to an instruction to open the interrupter.

The stroke of the second piston 8 towards the bottom 14 of the cylinder is limited by the first piston 7 by abutting against the back thereof.

The upper part of FIG. 1 shows the interrupter in the closed position. The fixed tubular arcing contact 1 is enclosed in the contact fingers of the moving arcing contact 4, and likewise the fixed tubular main contact 2 is enclosed in the contact fingers 3 of the moving main contact. The first piston 7 has its back pressed against the second piston 8 which is itself urged by the return spring 23 and is hooked to the top 16 of the blast cylinder.

The lower part of FIG. 1 shows the interrupter at the end of blasting after interrupting a high intensity current, e.g. a short circuit. After the opening instruction has been given, the first piston 7 is mechanically driven towards the bottom 14 of the blast cylinder by the circuit breaker actuator mechanism, and it is followed by the second piston 8 driven by the electrodynamic forces of the interrupted current. At the beginning of the stroke, the means for coupling the second piston 8 to the top 16 of the cylinder are released and the main moving contacts 3 leave the main fixed contacts 2 thereby diverting the current to the arcing contacts 1 and 4. A little later, the arcing contacts 1 and 4 are separated, thus drawing current arcs that occult the blast nozzle 5; the second piston 8 is set in motion by the electrodynamic force of the current which exceeds the force of the return spring 23 and compresses the inside volume of the blast cylinder to enable high intensity currents to be interrupted. Both pistons 7 and 8 in their travel finally reach the bottom 14 of the blast cylinder. Once the current is interrupted, the electrodynamic attraction between the bottom 14 of the blast cylinder and the second piston 8 ceases, enabling the second piston to return to the top 16 of the cylinder under the action of the return spring 23 where it is again hooked while waiting for the interrupter to be closed.

To interrupt a small current, the second piston 8 stays in place at the top 16 of the blast cylinder. The hook means as released at the beginning of the stroke of the first piston reclose with the electrodynamic force developed by the current failing to overcome the force of the return spring 23.

In either case, very little control energy is required since blasting is assisted by the electrodynamic forces set up by the interruption current. Further, the low mass of the first piston 7 by which the moving contacts are carried enables very high translation speeds to be obtained.

FIGS. 2A, 2B, 2C and 2D show details of the system for coupling the second piston to the top of the blast cylinder, and show the system in different positions during circuit breaker operation.

The coupling system is essentially constituted by two or three hooks 30 which are mounted on the back of the second piston 8 around its periphery with lips 31 that hook on to an edge 32 formed by the outside rim of the annular slot 17. The hooks 30 are pivotally mounted about axes 33 which are fixed to the second piston 8, with their lips 31 turned towards the edge 32. A return spring 34 lodged in a well 35 formed in the back of the second piston hooks onto the tail of each hook 30 which it tends to tilt into its hooking position. An uncoupling tie 36 has one end hinged to a lug 37 which projects from the back of each hook 30 close to its lip and its other end hinged to a socket 38 which is slidably mounted in a well 39 passing right through the second piston and ending at the front of the second piston in a chamber 40 into which the back of the first piston 7 is at least partially received. The back of the first piston 7 is fitted to the dimensions of the chamber 40, and the socket 38 if fitted to the dimensions of the well 39 in such a manner that the socket 38 and consequently the uncoupling tie 36 are actuated by suction when the back of the first piston leaves the chamber 40. Apart from the suction effect, the tie 36 and the socket are held back by the return spring 34 of the hook 30.

Figure 2A:
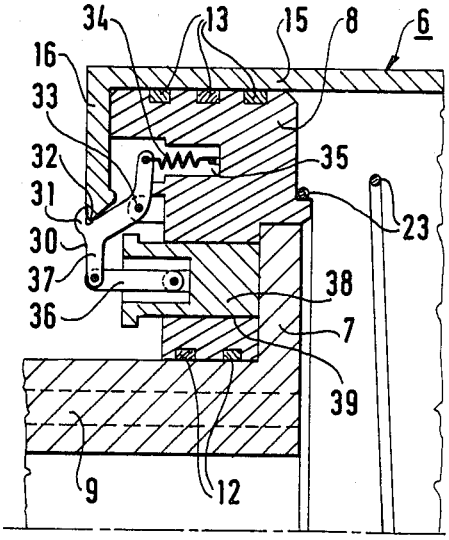
FIGS. 2A, 2B, 2C and 2D show details of the coupling mechanism for the second blast piston of the interrupter shown in FIG. 1, and the respective positions of its various parts during a maneuver.

FIG. 2A shows the coupling system when the interrupter is closed. The back of the first piston 7 is received in the chamber 40 of the second piston 8. The second piston is urged against the top 16 of the blast cylinder by the spring 23 and is locked by the hooks 30 having their lips 31 pressed against the edge 32 by the return springs 34.

Figure 2B:
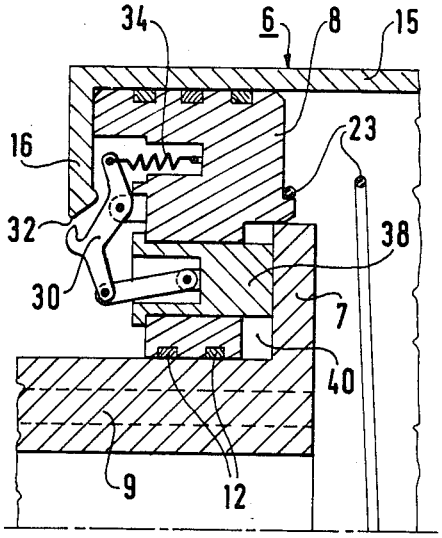

FIG. 2B shows the coupling system at the beginning of interrupter opening. The first piston 7 is beginning to be driven by the circuit breaker actuator mechanism. When the main moving contacts 3 are on the point of loosing contact with the main fixed contacts 2, the back of the piston has moved part of the way out from the chamber 40 thereby lowering the pressure therein, sucking the sockets 38 and tilting the hooks 30 to unlock the second piston 8.

Figure 2C:
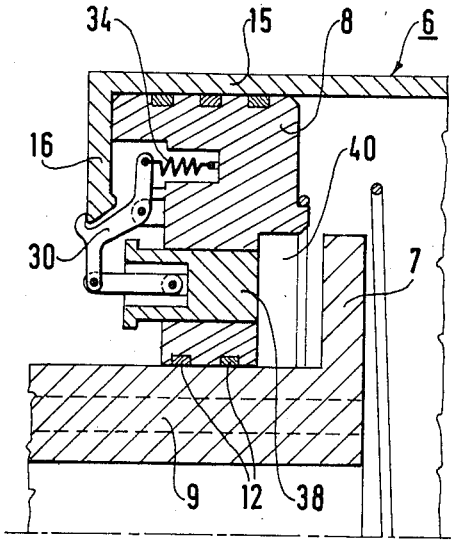

FIG. 2C shows the coupling system during opening of the interrupter in the event of a small intensity current which exerts insufficient electrodynamic force to overcome the return spring 23. The first piston 7 has continued its stroke towards the bottom of the cylinder thus clearing the chamber 40 of the second piston 8. The pressure drop in the chamber 40 has ended, the socket 38 is no longer subjected to suction, and the tie 36 no longer exerts any traction, thereby enabling the return spring 34 to return the hook 30 to the hooked position on the edge 32, thus re-locking the second piston 8 to the blast cylinder.

Figure 2D:
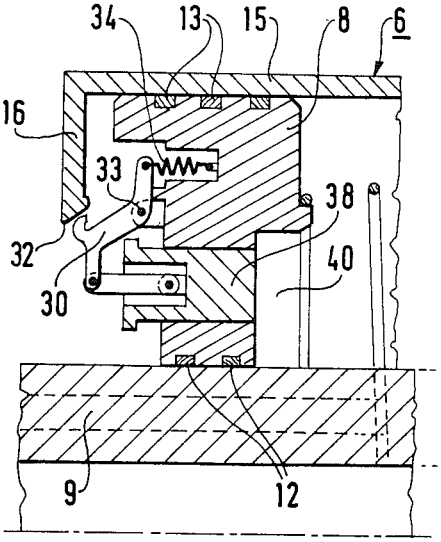

FIG. 2D shows the coupling system during interrupter opening on a high intensity current which exerts an electrodynamic force on the second piston 8 which is greater than the thrust of the return spring 23. The first piston 7 follows its stroke, clearing the chamber 40 of the second piston 8, thus leaving the hook 30 free to return to the coupling position under the action of the spring 34. However, the second piston 8 was set in motion while it was unlocked so the lip of the hook misses the edge 32 when it returns and the piston cannot be re-locked.

When the current stops, the return spring 23 causes the second piston 8 to move back towards the top 16 of the cylinder and the hooks 30 once again lock on the edge of 32.

This locking system may be slightly modified by placing magnetic shoes at the ends of the sockets 38 and in fitting the back of the first piston 7 with a magnetic material that exerts a force of attraction on the magnetic shoes. The chamber 40 is then superfluous.

Figure 3A:
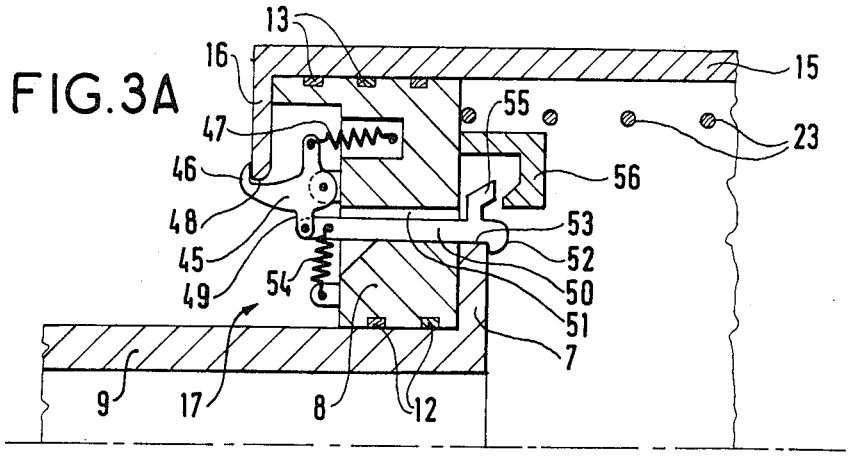
FIGS. 3A, 3B and 3C show a first variant of the coupling mechanism shown in the preceding figure and using hooks.
Figure 3B:
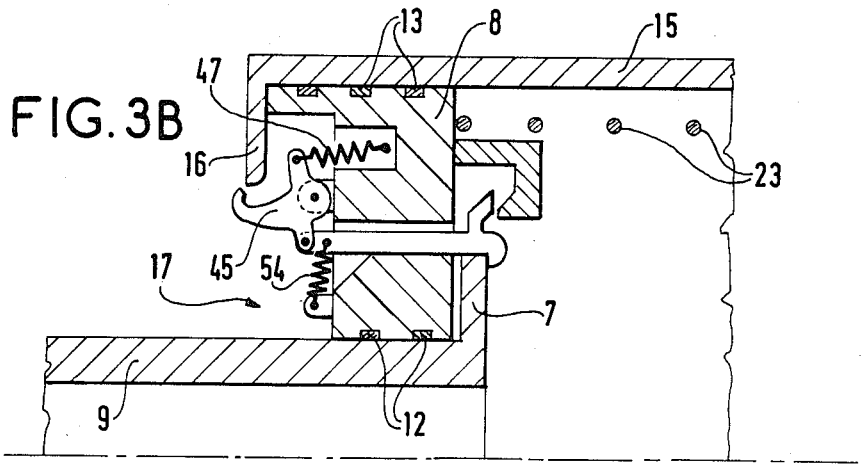
Figure 3C:
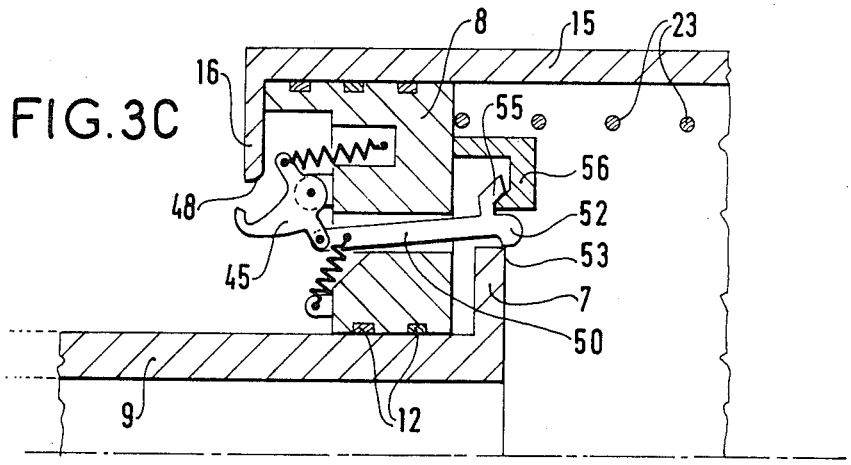

FIGS. 3A, 3B and 3C show details of a variant of the coupling system for the second piston 8. As before, the coupling system is essentially constituted by two or three pivoted hooks 45 which are distributed around the periphery of the back of the second piston 8 and which have lips 46 that are urged by return springs 47 to hook onto an edge 48 of the outside rim of the annular slot 17 in the top of the blast cylinder. Each hook 45, like the hooks in the preceding system, includes a lug 49 which extends the back of its lip 46 and which is hinged to one end of an upcoupling tie 50 received in a well 51 passing right through the second piston 8. The free end of the uncoupling tie 50 is terminated in a hook 52 which bears against an edge 53 of the first piston 7, a return spring 54 mounted on the back of the second piston 8 tends to apply the tie against the edge 53. The opposite side of the hook 52 has a disengagement tab 55 which engages a Γ-shaped cam 56 mounted opposite on the second piston 8.

FIG. 3A shows the parts in their positions when the interrupter is closed. The first piston 7 is pressed against the second piston 8. The spring 23 urges the second piston 8 against the top 16 of the cylinder to which it is locked by the hooks 45 which are maintained in position by the springs 47. The uncoupling tie 50 is hooked to the first piston 7 under the action of the spring 54.

FIG. 3B shows the parts in their positions at the beginning of interrupter opening.

The first piston 7 has begun to be move under the control of the circuit breaker actuator mechanism and in so moving it draws the uncoupling ties 50 which tilt the hooks 45 and unlock the second piston 8.

FIG. 3C shows the positions of the parts after the beginning of interrupter opening. The first piston 7 continues to move away from the second piston, thus continuing to draw away the uncoupling ties 50 until their disengagement tabs 55 engage the ends of the cams 56, thus uncoupling the uncoupling ties 50. The ties are then retracted into the second piston 8 under the action of the springs 47 which also return the hooks 45 to their hooking positions. The disengagement tabs 55 of the uncoupling ties 50 then abut against the second piston 8, leaving the free ends of the ties in position for hooking onto the first piston 7.

If the interrupted current is not of sufficient intensity to move the second piston 8 while it is unlocked, it is locked once again and waits for the interrupter to be closed so that the uncoupling ties 50 may once again be hooked to the first piston 7. If, on the contrary, the current being interrupted is of sufficient intensity to set the second piston 8 in motion while it is unlocked, then it cannot be re-locked immediately since the edge 48 is not hooked by the lips of the hooks 45 when they return. Locking will only take place after the fault current has ceased and the second piston 8 has returned to the top of the cylinder under the action of the spring 23.

Figure 4A:
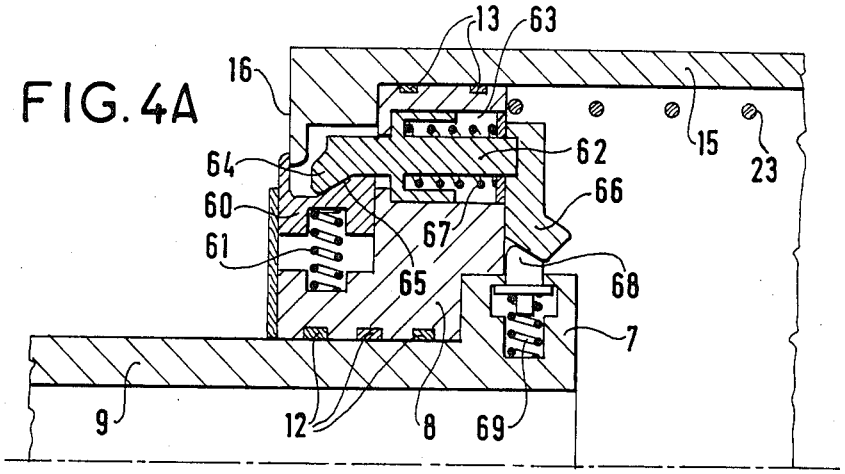
FIGS. 4A, 4B and 4C show a second variant of the mechanism for coupling the second blast piston of the interrupter shown in FIG. 1 and using bolts.
Figure 4B:
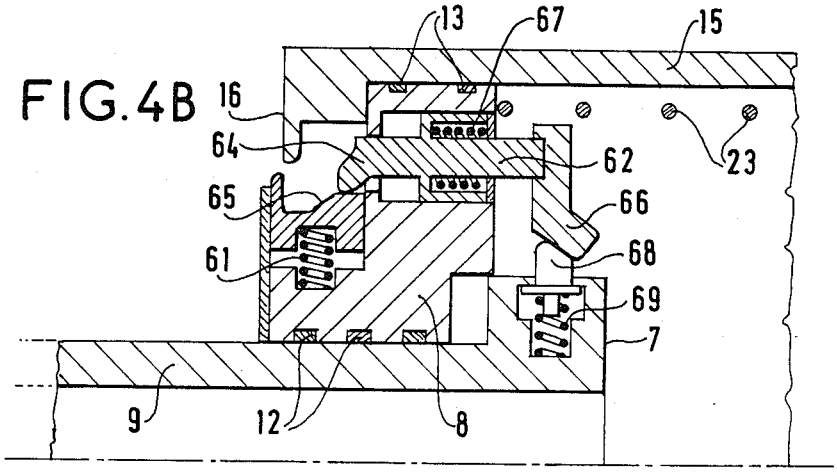
Figure 4C:
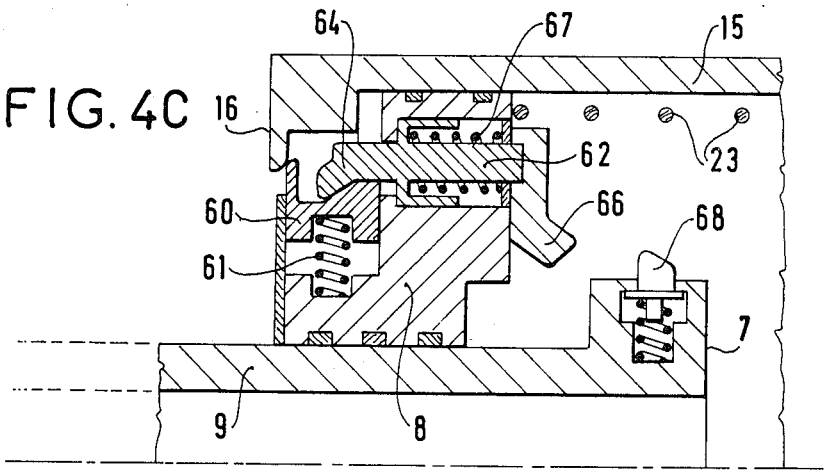

FIGS. 4A, 4B and 4C show details of a bolt-action variant of the coupling system for the second piston 8. This coupling system includes two or three bolts 60 distributed around the periphery of the back of the second piston 8, said bolts latching onto the top 16 of the cylinder on the outer rim of the slot 17 and being manipulated by the first piston 7 through the second piston 8. The bolts 60 are slidably mounted in radial grooves made in the back of the second piston. They are turned towards the periphery thereof and they are urged in this direction by return springs 61 which are placed in the grooves and which ensure the closing maneuver. The outside wall of the annular slot 17 serves as a catch. The bolts are opened by ties 62 which slide perpendicularly to the bolts in wells 63 through the second piston 8. At the bolt end of each tie 62 there is a cam 64 which co-operates with an inclined surface 65 of the bolt 60 to move it to the open position, and the other end of the tie has a finger 66 which projects from the second piston 8 towards the outside edge of the first piston 7 and which is made from a washer. The ties are held captive in their wells 63 and they are urged towards the outside of the second piston 8 by return springs 67. The first piston 7 engages the finger 66 by means of a push-button 68 which is resiliently mounted in the edge by a spring 63 which is stiffer than the bolt return spring 61.

FIG. 4A shows the coupling system when the interrupter is closed. The first piston 7 comes against the second piston 8 which is itself urged against the top 16 of the cylinder by the spring 23 and is locked thereto by the bolts 60 engaged on the rim of the annular slot 17. The ties 62 are retracted inside the second piston under the action of the springs 67. The push button 68 is lodged between the second piston 8 and the finger 66 for actuating the ties.

FIG. 4B shows the coupling system at the beginning of interrupter opening. The first piston 7 which is beginning to be displaced by the circuit breaker actuator mechanism draws the ties 62 by means of its push button 68 causing the bolts 60 to be retracted and the second piston to be unlocked.

FIG. 4C shows the coupling system after the beginning of interrupter opening, on a high intensity current when the ties 62 have reached their end stops, obliging the push button 68 to retract to escape from the finger 66. The ties are then retracted themselves under the action of the springs 67 and 61 and they release the bolts. The electrodynamic force of the current being interrupted has meanwhile moved the second piston far enough to prevent it being re-locked.

Figure 5A:
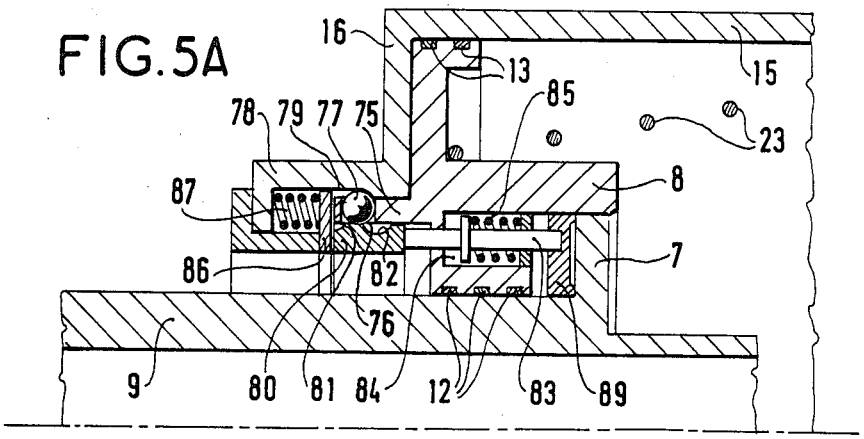
FIGS. 5A, 5B and 5C show a second variant of the mechanism for coupling the second blast piston of the interrupter shown in FIG. 1 and using locking balls.
Figure 5B:
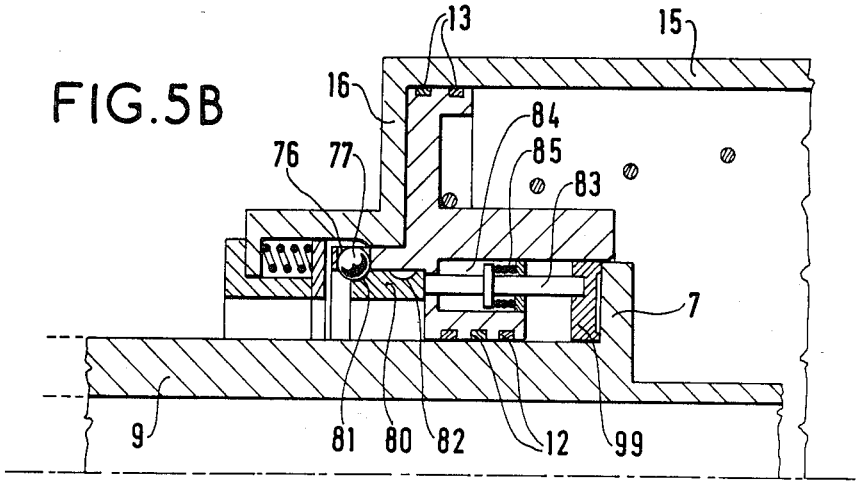
Figure 5C:
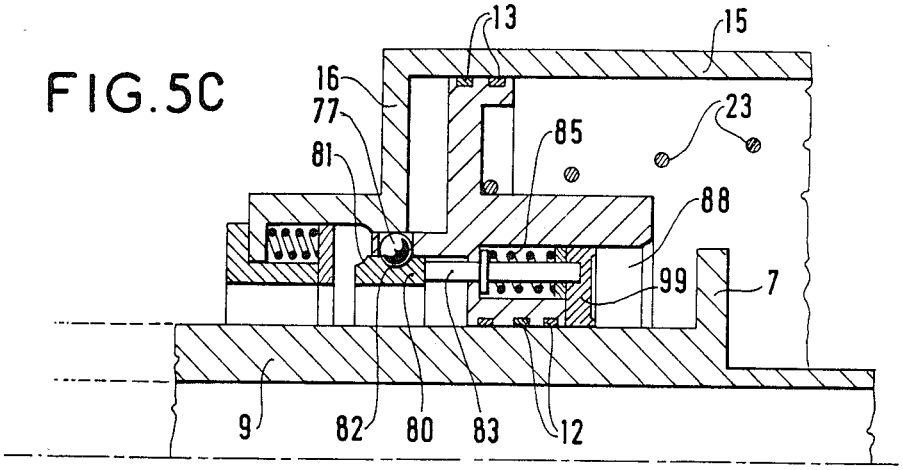

FIGS. 5A, 5B, and 5C show details of a ball bearing latching variant of the coupling system for the second piston 8. The back of the second piston 8 is extended by a circular ridge 75 with ball cages distributed round its periphery, each comprising a radially extending hole 76 in which a ball 77 is retained with play. The diameter of the balls 77 is greater than the thickness of the ridge 75. The top 16 of the cylinder is extended around the rim of the annular slot 17 by a tubular portion 78 in which the ridge 75 is received when the second piston 8 is pressed thereagainst by the spring 23. The tubular portion 78 has its inside diameter fitted to the outside diameter of the ridge 75 and has an inside bore 79 forming a latching groove which is located opposite the balls when the second piston is pressed against the top 16 of the cylinder. A latching ring 80 is slidable inside the ridge 75. It has two outer peripheral grooves 81 and 82, one above the other. It is mounted on longitudinal shafts 83 which move in wells 84 passing through the second piston 8 between two positions corresponding to having the balls 77 received in the peripheral groove 81 or 82. Springs 85 are placed around the shafts 83 in the wells 84 and tend to cause the latching ring 80 project out rom the back of the of the second piston 8 so as to put the groove 82 in place to receive the balls 77. An annular stop 86 is placed inside the tubular portion 78 of the cylinder on springs 87 which are stiffer than the springs 85 on the shafts 83 and which tend to return the latching ring into the second piston in such a manner as to place the wall separating the two grooves 81, 82 opposite the ball 77 when the second piston 8 is pressed against the top of the cylinder. The ends of the shafts 83 opposite from the latching ring 80 project from their wells 84 to the front face of the second piston 8 at the bottom of a chamber 88 in which the back of the first piston is at least partially received. They are fixed to an annular socket 89 which is slidably mounted at the bottom of the chamber 88 and which is drawn by the suction effect of the back of the first piston 7 when it leaves the chamber 88.

FIG. 5A shows the coupling system when the interrupter is closed. The back of the first piston 7 is received in the chamber 88 of the second piston 8. The second piston 8 is urged against the top 16 of the cylinder by the spring 23. Its ridge 75 with the ball cages is completely received in the tubular portion 78 of the top of the cylinder. The latching ring 80 is urged by the springs 85 against the annular stop 86 which holds it in an intermediate position from which it pushes the balls 77 into the groove 79 of the tubular portion of the top of the cylinder by means of the wall separating the two grooves 81, 82, thus locking the second piston 8 to the top of the cylinder.

FIG. 5B shows the coupling system at the beginning of interrupter opening. The first piston 7 has begun to be moved by the circuit breaker mechanism and moves out from the chamber 88, thereby reducing the pressure therein and thus drawing the annular socket 89 by suction, and consequently drawing the latching ring 80 which presents its groove 81 to the balls 77, enabling the balls to come out from the groove 79, and so unlocking the second piston 8.

As the interrupter open movement continues, the first piston 7 clears the chamber 88 thus ending the suction effect and releasing the latching ring 80 which either returns to its intermediate position if the second piston 8 has not started moving under the effect of the electrodynamic forces generated by the interrupter current, thereby re-locking the second piston, or else, if the second piston has escaped from the top of the cylinder, it passes to its position in which it is projecting as far as possible from the back of the second piston 8 with its groove 82 next to the balls 77.

FIG. 5C shows the coupling system on return of the second piston 8 after interrupting a high intensity current. The second piston is propelled towards the top of the cylinder by the spring 23 with its latching ring 80 in its position in which it is projecting as far as possible from the back of the second piston, with its groove 82 facing the balls 77. The balls 77 meet the inside wall of the tubular portion 78 at the top of the cylinder and are pushed into the groove 82, thus locking the latching ring in position. While still locked, the latching ring abuts against the annular stop 86 which it pushes under the action of the spring 23 until the balls can escape into the groove 79 in the tubular portion 78 of the top of the cylinder. The latching ring is then no longer locked to the second piston and it is pushed into the piston by the annular stop 86 until the wall between the grooves 81 and 82 comes opposite the balls 77, thereby re-locking the second piston 8 at the top of the cylinder.

I claim:

1. In a puffer-type gas-blast circuit-breaker including an interrupter comprising; a gas-blast arc-extinguishing mechanism having a fixed cylinder (6) with a top (16) and bottom (14) joined by a cylindrical end wall, fixed main contact fingers (2) and arcing contact fingers (1), movable main contact fingers (3) and arcing contact fingers (4), a mechanism of said gas-blast arc-extinguishing assembly for moving said movable main contact fingers (3) and arcing contact fingers (4) relative to said fixed main contact fingers (2) and arcing contact fingers (1), the improvement wherein the gas-blast assembly includes two concentric pistons (7, 8) mounted within the cylinder (6) for axial movement therein between said top and bottom and including a first piston (7) driven by the mechanism and serving to move the moving contacts (3, 4); and a second free piston (8), said pistons (7, 8) and said cylinder (6) delimiting a volume of blast-gas in a current loop used by the opening current which passes via the arcing contacts (2, 4), said opening current passing therethrough in the same radial direction as it passes through the bottom (14) of the cylinder; resilient return means (23) placed inside the cylinder (6) between the bottom (14) and the second piston (8) to urge said second piston (8) against the top (16) of the cylinder in such a manner as to maximize the volume of the blast-gas; and coupling means (30) for locking the second piston (8) to the top (16) when it reaches the top (16) of the cylinder under the action of the resilient return means 923) and means responsive to movement of said first piston (7) when it leaves the vicinity of the top (16) of the cylinder for releasing said coupling means (3) at opening of the interrupter.

2. A circuit-breaker according to claim 1, wherein the stroke of the second piston (8) towards the bottom (14) of the cylinder is limited by said second piston (8) abutting against the back of the first piston (7).

3. A circuit-breaker according to claim 2, wherein the coupling means include pivoting hooks (30) fixed to the back of the second piston (8) having ends hooking onto an edge (32) made in the wall of the top (16) of the cylinder, and return springs (34) for returning the hooks (30) to their hooking position, uncoupling ties (36) fixed at one end to the hooks (30) and passing through the second piston (8), and being movable a certain distance by the first piston (7) acting on their other ends when it leaves the vicinity of the top (16) of the cylinder (6).

4. A circuit-breaker according to claim 3, wherein the face of the second piston (8) has a chamber (40) hollowed out therein, the back of the first piston (7) being snugly received in said chamber, and the ends of the ties being hinged to sockets (38) slidably mounted snugly in wells (39) passing through the second piston (8) and ending in said chamber (40).

5. A circuit-breaker according to claim 3, wherein the ties have free ends hinged to magnetic shoes sliding snugly in wells passing through the second piston opposite to the back of the first piston, and wherein the back of the first piston is equipped with magnetic material opposite said wells for exerting a force of attraction on the magnetic shoes.

6. A circuit-breaker according to claim 3, wherein the free ends of the ties (50) are terminated by hook lips (52) engageable with an edge (53) of the first piston (7) under the action of a second return spring (54) and disengagement tabs (55) on the opposite side of the hook lips (52), said tabs being engageable with a facing escape cam (56) carried by the second piston (8).

7. A circuit-breaker according to claim 2, wherein the coupling means comprise bolts (60) sliding in radial grooves in the back of the second piston (8), said bolts being engageable with catches in the wall of the top of the cylinder under the action of springs (61), ties (62) sliding perpendicularly to the bolts (60) in wells running through the second piston (8) with bolt-moving cams (64) at their bolt ends and a finger (66) at their first piston ends engaging a push button (68) resiliently mounted in the edge of the first piston (7), each tie (62) being help captive in its well and being urged to a locking position by a spring (67).

8. A circuit-breaker according to claim 2, wherein the coupling means include ball cages placed in a ridge projecting from the back of the second piston (8), a tubular wall (78) projecting from the top (16) of the cylinder which surrounds the ball cage ridge (75) and which has a locking groove (79) formed therein for placement opposite the balls (77) when the second piston (8) comes against the top (16) of the cylinder, a locking ring (80) placed inside the ball cage ridge (75) and mounted on shafts (83) which slide in wells (84) passing through the second piston (8) and being urged towards the back of the second piston by springs (85) and being provided with two peripheral grooves (81, 82), one above the other, including an upper groove (8) which is level with the balls (77) when the ring (80) is fully retracted into the second piston (8), and a lower groove (82) which is level with the balls (77) when the ring (80) is fully extended, a resilient stop (86) capping the tubular portion (78) of the top (16) of the cylinder and pressing against the locking ring (80) when the second piston (8) is in contact with the top (16) of the cylinder in such a manner as to place the wall separating the two grooves (81, 82) level with the ball cages, and means for causing the locking ring (80) to be driven over a certain distance by the first piston (7) when it leaves the vicinity of the top (16) of the cylinder.

9. A circuit breaker according to claim 8, characterized in that the face of the second piston is hollowed out to form a chamber (88) into which open out the wells (84) of the locking ring carrying shafts (83), and in which the back of the first piston (7) is a snug fit, and wherein the means for driving the locking ring (80) by the first piston (7) are constituted by an annular socket (89) fixed to the free ends of the shafts (83) carrying the locking ring (80) and sliding snugly in the second piston (8) where the wells (84) open out into the chamber (88).

10. A circuit breaker according to claim 8, characterized in that the free ends of the shafts carrying the locking ring have magnetic shoes which come opposite to the back of the first piston, and wherein the back of the first piston is equipped with magnetic material which exerts a force of attraction on the magnetic shoes.

* * * * *